US005796219A

United States Patent [19]

Hirakimoto et al.

[11] Patent Number: 5,796,219

[45] Date of Patent: Aug. 18, 1998

[54] METHOD AND APPARATUS FOR CONTROLLING THE ACCELERATION ENERGY OF A RADIO-FREQUENCY MULTIPOLE LINEAR ACCELERATOR

[76] Inventors: Akira Hirakimoto, 2-1-6-401 Nishisakaidani-cho, Ohharno Nishigyo-ku Kyoto 604; Masatoshi Asari, 3-1-11 Shikanodai-Higashi, Ikoma Nara 630-01, both of Japan

[21] Appl. No.: 532,116

[22] Filed: Sep. 22, 1995

Related U.S. Application Data

[63] Continuation-in-part of Ser. No. 14,793, Feb. 8, 1993, abandoned, which is a continuation-in-part of Ser. No. 713,037, Jun. 7, 1991, abandoned, which is a continuation of Ser. No. 379,337, Jul. 12, 1989.

[30] Foreign Application Priority Data

Jul. 15, 1988 [JP] Japan ..... 63-176540

[51] Int. Cl.[6] ..... H05H 7/12

[52] U.S. Cl. ..... 315/500; 315/506; 315/507

[58] Field of Search ..... 315/500, 505, 315/506, 507, 5.41, 5.42; 313/359.1

[56] References Cited

FOREIGN PATENT DOCUMENTS 60-115199 6/1985 Japan .

OTHER PUBLICATIONS

K. Tokiguchi, et al; Nuclear Instruments and Method in Physics Research B 37/38 (1989) 253–255.

*Primary Examiner*—Nimeshkumar D. Patel

[57] ABSTRACT

A method for controlling a particle acceleration energy in a radio-frequency quadrupole accelerator, the method being particularly adapted for ion implantation in the process of manufacturing semiconductor devices, wherein the particle acceleration energy is varied without the necessity of changing the resonant frequency of the RFQ accelerator so that the final energy of the particles has a plurality of distinct energy having a lower value than the designed voltage.

3 Claims, 7 Drawing Sheets

METHOD AND APPARATUS FOR CONTROLLING THE ACCELERATION ENERGY OF A RADIO-FREQUENCY MULTIPOLE LINEAR ACCELERATOR

This is a continuation-in-part of application Ser. No. 08/014,793, filed Feb. 8, 1993, now abandoned, which is a continuation-in-part of Ser. No. 07/713,037 filed Jun. 7, 1991, now abandoned, which is a continuation of Ser. No. 07/379,337, filed Jul. 12, 1989.

BACKGROUND OF THE INVENTION

1. Field of the Invention

The present invention relates to a method for controlling particle acceleration energy under a radio-frequency quadrupole accelerator. The method is particularly applicable to ion implantation in the process of manufacturing semiconductor devices.

2. Description of the Prior Art

A radio-frequency quadrupole accelerator (hereinafter called "RFQ accelerator") is generally known as useful for accelerating ion beam charged with a large electric current into a higher energy under the high transmissivity. Because of this favorable ability, the RFQ accelerator is nowadays in wide use.

As a typical example of the known RFQ accelerators, a vane type RFQ accelerator will be described by reference to FIG. 12, which schematically shows a perspective view which exemplifies the basic concept underlying the RFQ accelerators.

The known accelerator includes a cylindrical tank 90 having open ends closed by plates 91*a* and 91*b*. The tank 90 accommodates four vanes 92*a*–92*d*. The tank 90 constitutes a quadrupole cavity resonator. Each of the vanes 92*a*–91*d* has a wavy edge. The valleys and hills of the vanes 92*a*–92*d* respectively correspond to each other like valley-to-hill, and hill-to-valley, and the waveforms of the vanes 92*a* and 92*c* and of the vanes 92*b* and 92*d* are differentiated by 180° from each other. The cycle of each waveform becomes longer progressively from the entrance toward the exit, which will be hereinafter described in detail. The cycles of the waveforms are the same at the exits of the vanes 91*a* –91*d*.

The (i)th acceleration cell from the entrance of each vane 92*a* to 92*d* has a length of $\frac{1}{2}\beta_i\lambda$ whose value can be determined by the following equation:

$$\frac{1}{2}\beta_i\lambda = \frac{1}{2}\frac{v_i}{c}\frac{c}{f} = \frac{1}{2}\frac{v_i}{f} \tag{1}$$

where $\lambda$ is a wave length at resonant frequency, f is a resonant frequency, $v_i$ is a particle velocity at which particles pass through the (i)th acceleration cells, and c is the velocity of light.

The particles obtain an energy gain every time when they pass through the acceleration cells. When they pass through the (i)th wavy acceleration cells, the particles have an energy gain having the following value:

$$\Delta W_i = \frac{\pi}{4} qeA_i V\cos\phi_i \tag{2}$$

where q is the charge state of particles, e is the unit of elementary charge, V is voltage induced for the resonant frequency power, and $\phi_i$ is a phase of the synchronous particles in the (i)th acceleration cell ("synchronous particles" means "ideal equilibrium particles" that obey the designed parameters of the accelerator. Then the energy gain of the synchronous particles exactly equals the $\Delta$Wi of the equation (2) and the final energy of the synchronous particles also exactly equals $W_N$ of the equation (4).$\phi$i must have a non-positive value because of the fundamental principle of phase stability in linear accelerators. The non-synchronous particles, whose phase $\phi$ is within the range of $2\phi i \leqq \phi \leqq -\phi i$ and $\phi \neq \phi i$, also have phase stability. Because of the difference of the multiplying factor "cos$\phi$i" and "cos$\phi$" in the equation (2), the energy gain of these particles is not exactly equal to the $\Delta$Wi of the equation (2) but oscillates around the value of the $\Delta$Wi. In the end, the non-synchronous particles whose phase $\phi$ is within the range of $2\phi i \leqq \phi \leqq -\phi i$ wherein $\phi$ does not equal to $\phi$i are also accelerated to an energy value around the final designed energy. On the other hand, non-synchronous particles whose phase is within the range of $\phi \leqq 2\phi i$ or $-\phi i \leqq \phi$ have no phase stability and are lost in the following successive acceleration process owing to weak focusing forces. This theoretical description is true in a conventional linear accelerator having weak focusing force, such as an Alvarez type. While it may seem to be true for the RFQ type having a strong focusing force, it is not) and $A_i$ is an acceleration efficiency, which is calculated as follows:

$$A_i = \frac{m^2 - 1}{m^2 I_o(ka) + I_o(mka)} \tag{3}$$

where "m," "k" and "a" are relevant to the vane geometry shown in FIG. 9. The distance "a" is defined as the minimum radius between a pair of opposite vanes. The quantity "m" is defined as the modulation ratio of the maximum radius to the minimum one. "k" is $2\pi/\beta_i\lambda$. The function $I_O$is a modified Bessel function of order zero. An example of these parameters of the RFQ, "$W_i$", "m", "a", and $\phi$ is shown in FIG. 10. In the following equation (4), $W_O$ is energy with which the particles introduced into the RFQ accelerator are discharged with final energy $W_N$where N is the ordinal number of acceleration cells of the vanes 92*a*–92*d*.

$$\begin{aligned} W_N &= \sum_{i=1}^{N} \Delta W_i + W_0 \\ &= \sum_{i=1}^{N} \frac{\pi}{4} qeA_i V\cos\phi_i + W_0 \end{aligned} \tag{4}$$

As is evident from the above-mentioned description, the resonant frequency f, the waveforms of the vanes ($\frac{1}{2}\beta_i\lambda$, a, and m), a phase of the synchronous projectiles $\phi_i$an initial energy $W_O$ and an acceleration voltage are mutually interrelated factors in the RFQ accelerator. In order to design a particular RFQ accelerator, one has to determine or calculate these certain parameters, i. e., $W_O$, $W_N$, V, Ai and $\phi$i. It is the usual procedure that $W_O$ and $W_N$ are first determined to the targeting constant values of $W_{IN}$ (injection energy) and $W_{OUT}$ (output energy). The voltage V is determined by the RF power supply capability. The rest of the parameters, Ai and $\phi$i, are next calculated in order to obtain $W_O$=$W_{IN}$ and $W_N W_{OUT}$. To calculate Ai, it is equivalent to calculate m (the modulation factor) a (the minimum radius) and k ($2\pi/\beta i\lambda$) according to equation (3). In the present case, $W_{IN}$ is set to 6 keV/amu, $W_{OUT}$ is set to 92 keV/amu and V to 54.8 kV for Nitrogen—14, 43 kV for Boron—11, respectively. These parameters m, a,$\phi$i and $W_i$ are shown in FIG. 10. As for the usual RFQ design, $\phi$i is first set to be −90 degrees at the inlet and approaches zero and then is set to be a constant value (for the RPQ of the present invention, −30 degrees) at the exit nearby. The constant $\phi$i region at the exit nearby is called the accelerator section in the RFQ. The synchronous particles exactly obey these parameters as described above.

In order to make the particle acceleration energy variable, the known RFQ accelerator requires the resonant frequency f to be variable, and the voltage at the resonant frequency to be varied and tuned with the varied frequency (Nuclear Instruments and Method in Physics Research B21 (1987) p-p218–223, H. F. Glavish, "Radio-Frequency Linear Accelerators for Ion Implanters").

For example, even if the voltage at the resonant frequency is changed with the other factors remaining unchanged, the accelerating energy will not be changed and remain constant. If the resonant frequency voltage is excessively reduced, the charged particles cannot be accelerated. This is because the energy gain of the charged particles of each acceleration cell is reduced (which means that the velocity becomes slow) in the accelerating electric field in accordance with the reduction of the voltage at the resonant frequency so that the resonant conditions are not satisfied with respect to the cycle of the waveform.

In the ion implantation process of manufacturing semiconductor devices and other applications, variable energy particle acceleration is essential. In order to achieve variable energy particle acceleration, there is an RFQ accelerator disclosed in Japanese Laid-Open Patent Application No. 60-115199, which includes an external resonator.

This known accelerator has disadvantages of high cost and difficulty in maintenance, derived from the fact (1) that the accessory resonator is expensive because of its complicated structure, (2) that the resonant frequency power source for generating an acceleration voltage must also have a variable frequency capability.

SUMMARY OF THE INVENTION

The present invention is directed to overcome the disadvantages discussed above with respect to the known method for controlling a particle acceleration energy:

According to the present invention, there is provided a method for controlling a particle acceleration energy in a radio-frequency quadrupole accelerator, including a cylindrical tank accommodating four electrodes extending axially of the tank, each electrode having a wavy cell having a length of ½ cycle expressed by the following equation (a), and introducing charged particles into the RFQ accelerator at an incident energy $W_O W_{IN}$ by supplying a radio-frequency power having the same frequency as the resonant frequency f of the RFQ accelerator and the voltage V expressed by the following equation (b) so that the synchronous particles pass through each wavy cell in a resonant condition whereby the particles possess an energy gain expressed by the equation (b) and are discharged with a final energy $W_N$ expressed by the equation (c); If the voltage induced for the resonant frequency, V, is reduced, the energy gain of the synchronous particles is also reduced and can not obey the design for accelerator parameters. But some particles, whose phase $\phi$is $\phi i < \phi$ (for the higher energy gain) and also within the range of $2\phi i \leqq \phi \leqq -\phi i$ (for the phase stability), get more energy gain than the synchronous particles do and still have phase stability even if V is reduced. These particles can compensate for the energy gain reduction caused by the voltage drop because the multiplying factor cost is larger than $\cos\phi i$ of the equation (b), and can keep the designed for energy gain $\Delta W_i$unchanged. But there is, of course, a limitation to maintain the designed energy gain unchanged. The first reason is that $\phi i$ approaches zero along the acceleration process (see FIG. 10), so that the energy gain of the synchronous particles increases and compensation will become difficult along with the acceleration process. The most difficult region is the acceleration section at the exit nearby where the synchronous phase is set to the maximum and a constant (for the present invention RFQ is −30 degrees). The second reason is that $\cos\phi$ does not exceed unity. If V is reduced to almost equal to or less than $V\cos\phi i$, no particles can compensate for the energy gain reduction caused by the voltage drop. In the end, all particles are lost owing to the weak focusing force. This is true in a conventional linear accelerator having weak focusing force. In the present invention, the accelerator is an RFQ having a strong focusing force. Therefore, if the voltage v is reduced to be almost equal to or less than $V\cos\phi i$ at i=N and the final energy $W_N$;

$$\frac{1}{2}\beta_i\lambda = \frac{1}{2}\ \frac{v_i}{c}\ \frac{c}{f} = \frac{1}{2}\ \frac{v_i}{f} \tag{a}$$

$$\Delta W_i = \frac{\pi}{4}\ qeA_i V\cos\phi_i \tag{b}$$

$$W_N = \sum_{i=1}^{N} \Delta W_i + W_0 \tag{c}$$

$$W_N' \approx W_{out}\left[1 + \left\{2L\left(\frac{2\Delta W_N}{W_N}\right)\right\} - \sqrt{\left\{2L\left(\frac{2\Delta W_N}{W_N}\right)\right\}^2 + 2\left\{2L\left(\frac{2\Delta W_N}{W_N}\right)\right\}}\right] \tag{d}$$

where i is the ordinal number of the wavy cell from the entrance of the RFQ accelerator;

c is the velocity of light;

$v_i$ is particle velocity when the particles pass through the (i)th wavy cells;

q is the electric charge of the particles;

e is the quantum of electricity;

$\phi i$ is the phase of the synchronous particles at (i)th wavy cell;

$\lambda_i$ is an acceleration efficiency expressed by:

$$A_i = \frac{m^2 - 1}{m^2 I_0(ka) + I_0(mka)}$$

where N is the number of wavy cells formed in each electrode (the ordinal number of the wavy cell located at the exit), and L is positive integers (1, 2, 3, 4 . . . )

By the equation (d), one can determine that $W_N i$ is almost independent of V. This is because $W_{OUT}$ is constant of the final energy value. Also, $\Delta W_{N/WN}$ is almost independent to V by the canceling out of V in $\Delta W_{N/WN}$ except for $W_O$. This situation is illustrated in FIG. 11, i. e., the particle energy spectrum at the exit of the designed RFQ. The voltage V is set to a designed value of 43 kV for Boron—11 in FIG. 11-A. The final energy $W_N = W_{OUT}$ is measured at to be 1.01 MeV and this value is equal to the design for value $W_{OUT}$=1.012 MeV. If the voltage V is reduced to 38.3 kV as in FIG. 11-B (almost equal to $V\cos\phi i$=37.2 kV for $\phi i$=−30 degrees at i=N), the single peak of 1.01 MeV is split into multiple peaks and shifted downwards. The 1.01 MeV designed for peak is observed but not dominant, whereas the split energy peaks of $\alpha$,$\beta$,$\gamma$, and $\delta$are clearly distinguished from the designed one and measured to be 0.68, 0.57, 0.50 and 0.45 MeV, respectively. If the voltage V is further reduced to 35.3 keV as in FIG. 11-C (a little less than $V\cos.\phi i$=37.2 kV at i=N), three split peaks are found at almost the same energy values of β, γ, and δ, whereas two peaks of the designed energy and αare not observed anymore. However, a new peak εemerges equal to 0.42 MeV. If the voltage V is excessively reduced less than Vcosφi, no distinct peak is found. In these observations, one can summarize the characteristics of the energy split phenomenon in the RFQ as follows: 1) since the energy values of β, γ and δ peaks are almost independent of the RF voltage V, the values of the split energies $W_N'$ are almost equal to V; and 2) since α is a dominant peak at V=38.3 kV, but 6 is at V=35.3 kV and the dominant peak of the split energy shifts downwardly as the voltage V decreases. The approximate equation (d) cannot provide peak intensities or yields of split peaks but predicts their energy values since it is an analytical approximation solution of the beam energy equation. In other words, whereas intensities or yields of split peaks are dependent on the voltage V, the shifted energies $W_N'$ are predetermined by the accelerator parameters according to the approximation equation (d) of the present invention.

According to the present invention, it is the radio-frequency voltage that is stepped down. More specifically, as is evident from the equations (1) to (4), the RFQ accelerator of the invention has unique vanes whose shape are closely related to the incident particle energy and the resonant frequency (i.e. the frequency of the radio-frequency power to be applied), and energy gain acquired by each wavy unit (i.e. the radio-frequency voltage), and makes it possible to control the particle acceleration energy by merely shifting the radio-frequency voltage down without changing the geometric requirements, the resonant frequency, or the frequency of the radio-frequency power to be applied.

The optimum value of the radio-frequency voltage V' after the voltage is shifted down is expressed by:

$$V' = V \cos \phi_N \tag{5}$$

where V is the regular radio-frequency, and φN is the phase of the synchronous projectiles of the wavy cell located nearest to the exit of each vane.

It is ascertained that by shifting in this way, the resulting final acceleration energy $W_N'$ is varied to indicate distinct values indicated by the following equation (6) when L=1, 2, 3. . . are put therein:

$$W_N' = W_{out}\left[1 + \left\{ 2L\left(\frac{2\Delta W_N}{W_N}\right)\right\} - \sqrt{\left\{ 2L\left(\frac{2\Delta W_N}{W_N}\right)\right\}^2 + 2\left\{ 2L\left(\frac{2\Delta W_N}{W_N}\right)\right\}}\right] \tag{6}$$

where $\Delta W_N$ is a particle energy gain obtained by a single wavy cell (radio-frequency wave ½ cycle) near to the exits of the vanes when the particle velocity is accelerated with the designed voltage V.

The reason why the particle acceleration energy is varied by shifting down the radio-frequency voltage applied to the vanes in the RFQ accelerator which accelerates the particle velocity under the conditions specified by the equations (1) to (4) is as follows:

The radio-frequency voltage to the vanes is dropped, phase delay occurs in some of a mass of the particles because of failing to keep synchronous condition. When it reaches the extent indicated by the equation (5), the phase delay occur in most of them. When they are delayed by 2π, that is, one cycle in radio-frequency, a semi-synchronous state is reached, thereby allowing these particles to pass through the RFQ accelerator. However, they are not in a synchronous state, and form a peak having a value smaller than the designed theoretical energy value.

As is the same as phase delay being 4π, 6π, 8π. . . , the energy is diminished in accordance with increases from 4π, 6π, 8π. . .

The strong focusing ability of the RFQ accelerator prevents the particles in the semi-synchronous state from being dispersed, and accelerates and leads them in the semi-synchronous state until the exit. In this way the particles are ejected with the final energy values of a variety in correspondence to the phase delay 2π, 4π, 6π. . . .

According to the present invention, the final energy can be varied by shifting down the voltage to be applied to the vanes of the RFQ accelerator, thereby varying the acceleration energy more easily than by the known method. Thus, the RFQ accelerator has come to be applicable to industrial fields where high energy and great current as well as variability of energy are required, such as ion implantation into semiconductor.

To put the RFQ accelerator into practice according to the present invention, it is not necessary to change the design of the known RFQ accelerator. The present invention can be easily applied to equipment where known RFQ accelerators are already put into operation.

BRIEF DESCRIPTION OF THE DRAWINGS

This invention may be better understood by reference to the accompanying drawings as follows.

DETAILED DESCRIPTION OF THE PREFERRED EMBODIMENT

Figure 1:
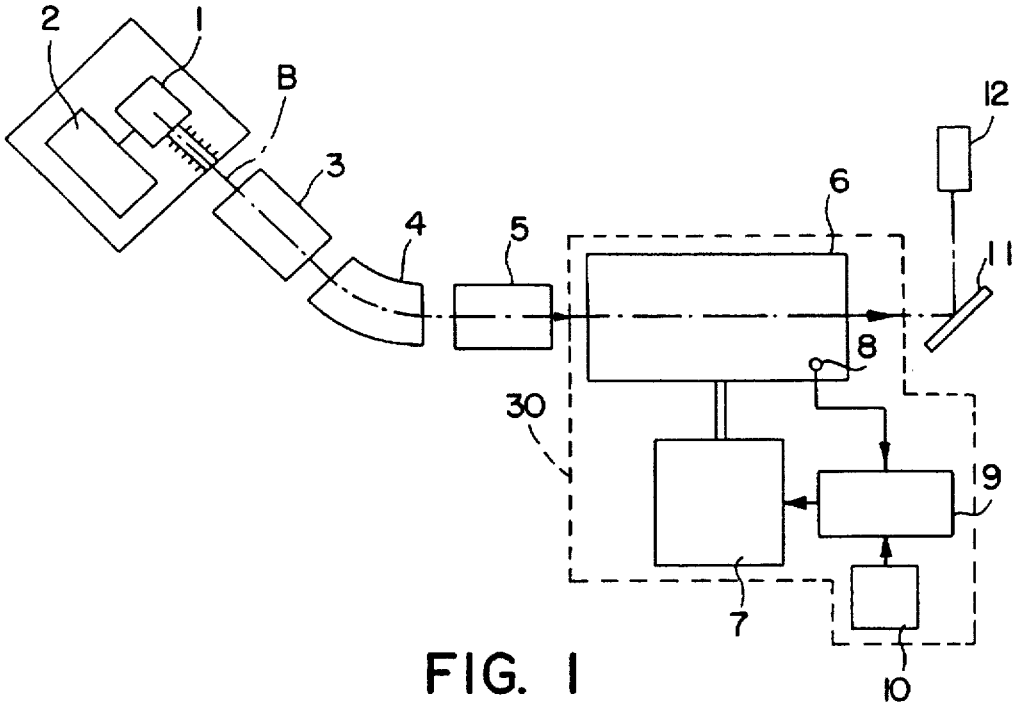
FIG. 1 is a block diagram showing the structure of an embodiment of the present invention.

Referring to FIG. 1, the exemplary RFQ accelerating apparatus 30, enclosed by broken lines, includes an accelerator 6 having vanes 92*a* to 92*d*, a voltage generator at resonant frequency 7, a pick-up loop 8, a controller 9, and a voltage setting device 3.

An ion generator 1 generates particles which are accelerated by a d.c. voltage source 2 so as to achieve a desired incident energy $W_O$. In this way a selected ion beam B is introduced into the RFQ accelerator 6 by passing through a first electrostatic quadrupole lens (hereinafter called "electrostatic Q lens") 3, an analyzing magnet 4, and a second electrostatic Q lens 5.

The voltage generator at resonant frequency 7 applies voltage to the vanes of the accelerator 6, wherein the applied voltage is detected by the pick-up loop 8. The voltage setting device 10 generates a setting signal. The controller 9 controls the voltage output by the generator 7 in response to the signals from the voltage pick-up loop 8 and the voltage setting device 10.

The voltage generator at resonant frequency 7 includes a quartz oscillator and a power amplifier. The controller 9 includes a circuit which feeds back a difference between the signals from the pick-up loop 8 and the setting device 10, and changes the amplitude in the power amplifier. In this way the voltage at resonant frequency to be applied to the vanes 92*a*–92*d* of the RFQ accelerator 6 is controlled by the voltage setting device 10.

The energy spectrum of the particles accelerated by the RFQ accelerator 6 is measured by a Rutherford Backscattering Spectroscopy (RBS) disposed at the exit of the RFQ accelerator 6. The RBS includes a target 11 and an energy detector 12 which receives the particles scattered by the target 11 and counts the number of particles (positive ions). As a result, electric charge is obtained depending upon the accelerated energy. By obtaining the electric charge of individual particles, the energy spectrum is measured. The target 11 is made by depositing a 100Åto 200Åthin gold film on a graphite plate, and the energy detector 12 is a surface barrier type.

FIGS. 3 to 8 show the values measured by the energy detector 12, in which the X-axis and Y-axis indicate energy and the number of particles, respectively.

FIGS. 3 to 6 show the results obtained by generating $^{14}N^{30}$ particles from $N_2$ gas in the ion generator 1. The $^{14}N^{30}$ particles were accelerated with an incident energy of 84 keV and introduced into the RFQ accelerator 6. The RFQ accelerator 6 had a constant resonant frequency of 70.300 MHz. The theoretical acceleration voltage value V obtainable from the equations (1) to (4) was about 54.8 kV.

Figure 3:
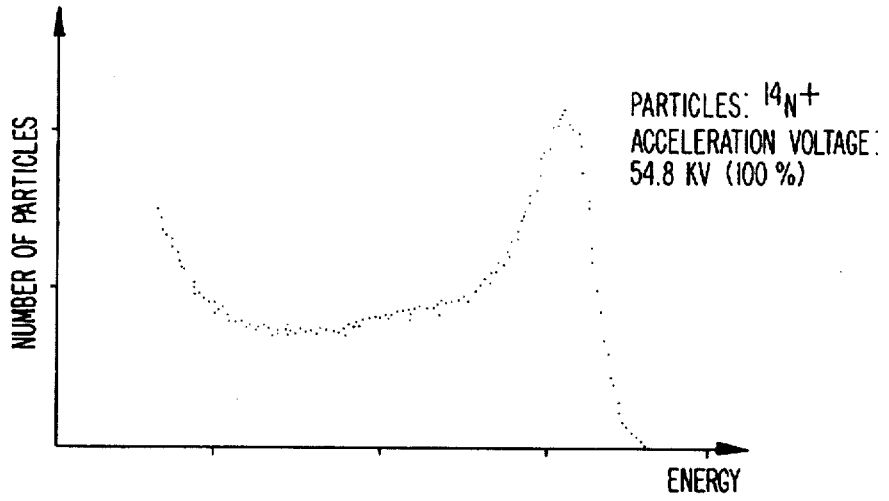
FIGS. 3 to 8 are graphs showing the relationship between the number of particles and the particle energy with parameter of acceleration vane voltage by using embodiment shown in FIG. 1.

FIG. 3 shows that the theoretical energy value had a mono-peak spectrum when the voltage of the vanes 92*a*–92*d* was set to 100%. The counted number in an area of the energy values except for the peak indicates the presence of particles having low energy scattered against the target 11 and the occurrence of noise.

Figure 4:
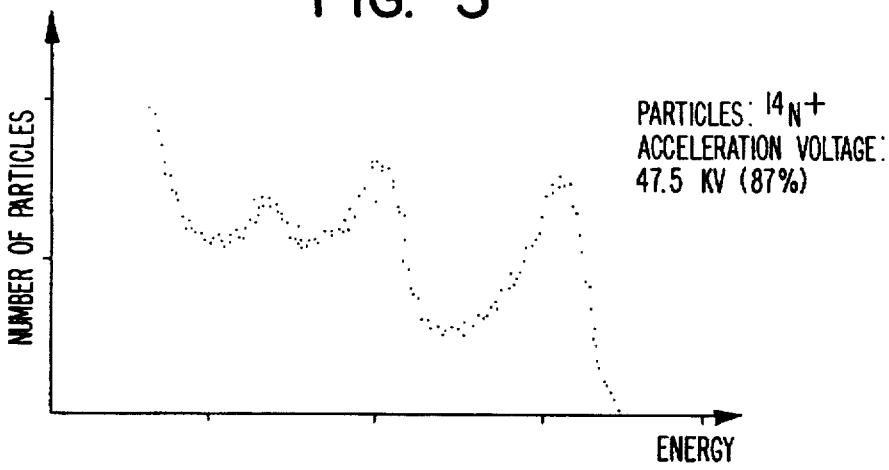
Figure 5:
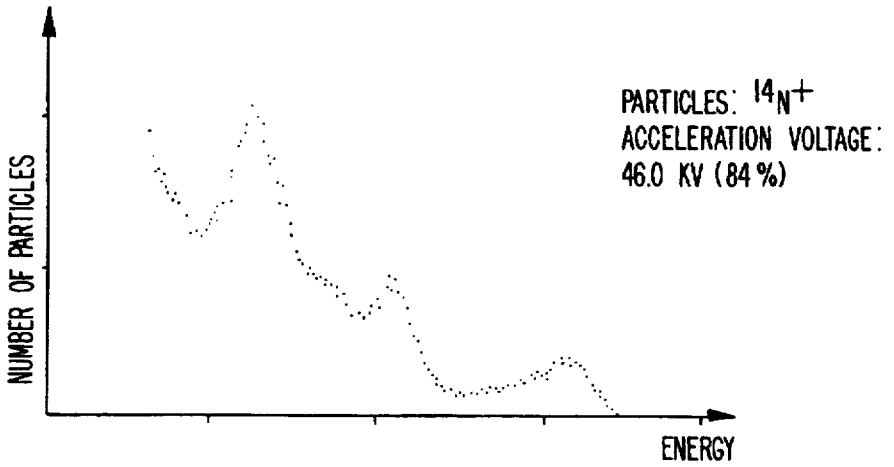
Figure 6:
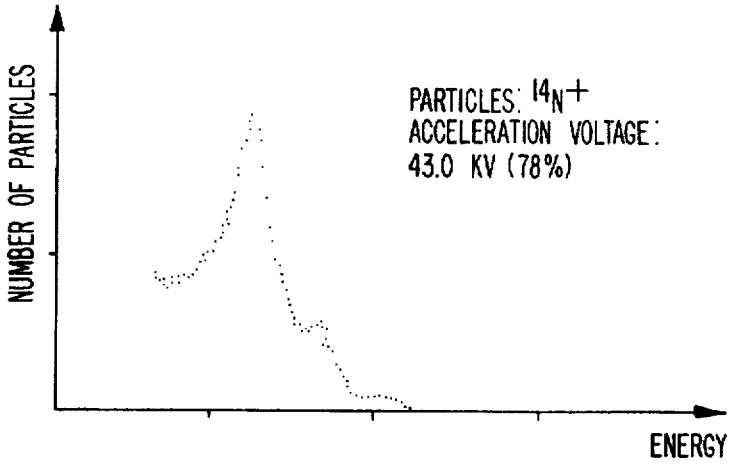

FIGS. 4, 5, and 6 show the spectra achieved when the acceleration voltages were respectively 87%, 84% and 78% of the designed energy peak 100. As is evident from FIGS. 4 to 8, as the acceleration voltages drop, one or more peaks occur in an energy area whose level is lower than the peak of FIG. 3. FIGS. 3 to 8 indicate that the final particle energy can be varied by merely changing the resonant voltage applied to the vanes 92*a*–92*d* of the accelerator 6.

Figure 7:
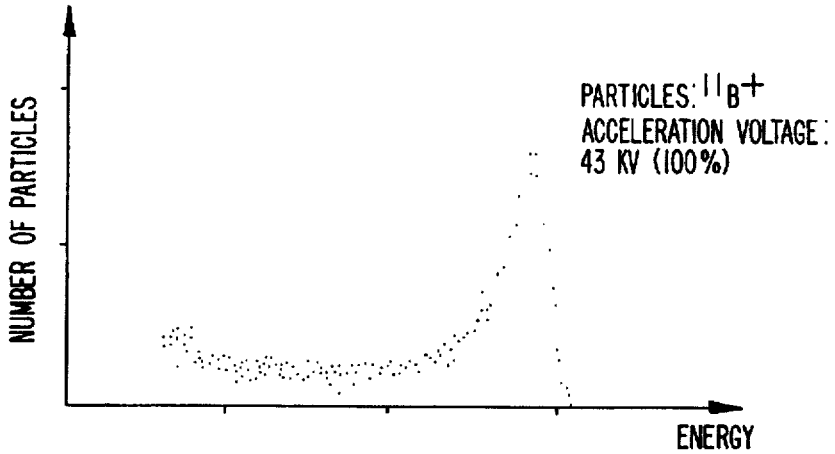
Figure 8:
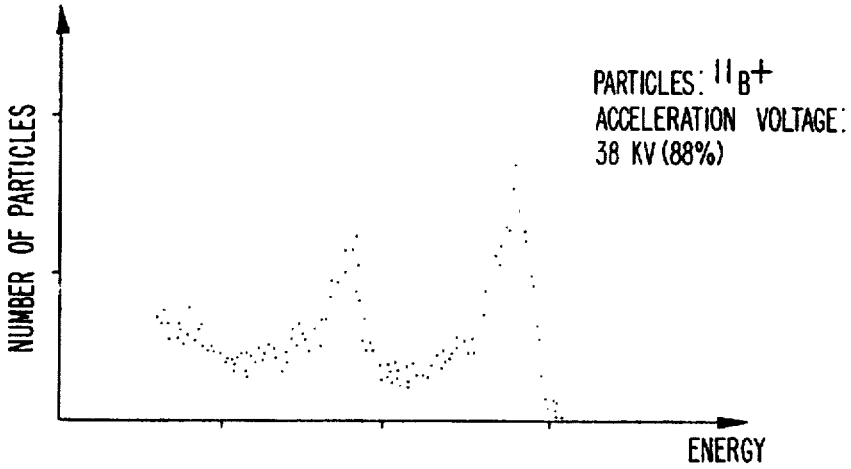
Figure 9:
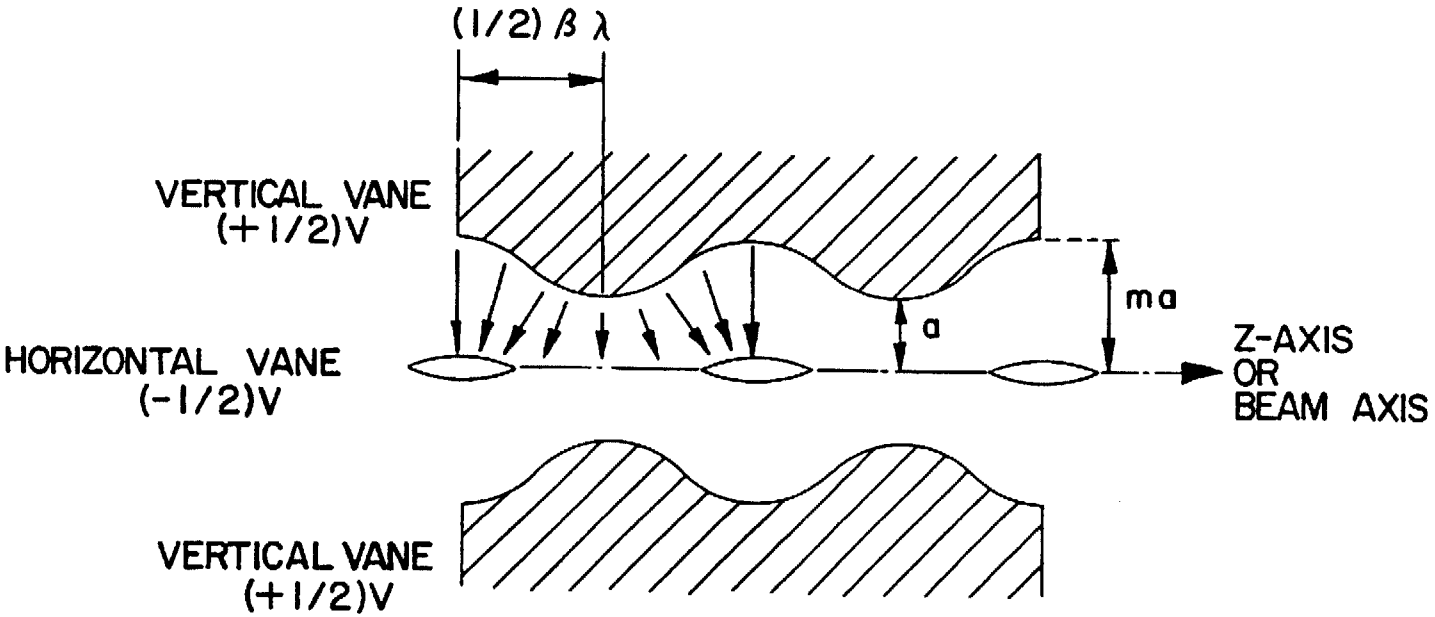
FIG. 9 is a graph showing the relationships among the wavy vanes of an RFQ accelerator and related parameters.

FIGS. 7 and 8 show the results of experiments conducted upon $^{11}B^{30}$ particles which were generated by the generator I from BF3 gas and after being accelerated to 66 keV, were introduced into the RFQ accelerator 6, wherein the resonant frequency was 70.430 MHz and the designed energy peak was about 43 kV.

FIG. 7 shows a spectrum obtained when the voltage was 100%, and FIG. 8 shows a spectrum obtained when the applied voltage was 88% by merely changing the vane voltage with the other parameters being constant.

The experiments also demonstrates that when 100% voltage is applied, a mono-peak appears at a designed energy value, whereas, according to the arrangement of FIG. 1, the shifting-down of voltage allows another peak to appear at a lower energy value than the peak value for the 100% voltage.

On the basis of the results of the experiments described above, the measuring instrument shown in FIG. 2 was used to obtain data relating to various parameters of the RFQ accelerator.

Figure 2:
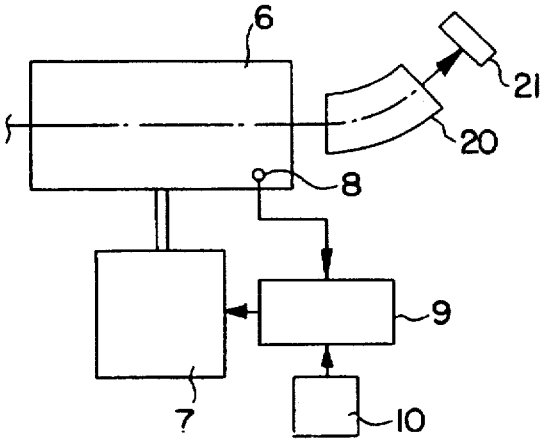
FIG. 2 is a block diagram showing the structure of another embodiment of the present invention.

Referring to FIG. 2 wherein like reference numerals refer to like and corresponding components to those shown in FIG. 1, there is provided an analyzing magnet 20 located adjacent to the exit of the RFQ accelerator 6 so as to guide the ions having a desired energy to an ammeter 21, and the coil current of the analytical magnet 20 is sweeped so as to enable the guiding ions to change their energy successively.

Figure 10:
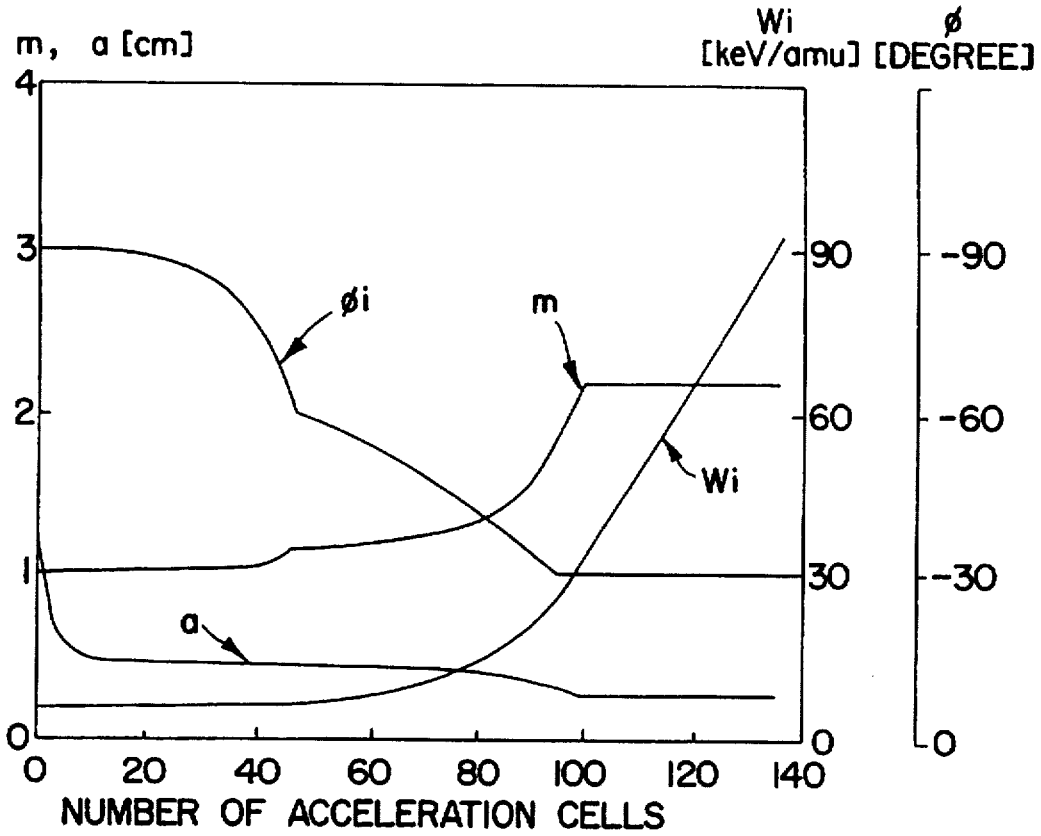
FIG. 10 is a graph showing the relationships between the ordinal number of acceleration cells from the entrances of the respective vanes and various parameters.

FIG. 10 shows the designed parameters of the RFQ of this experiment. The x-axis indicates the ordinal numbers of an acceleration cells from the entrances of the vanes 92*a*–92*d*.

By using the device shown in FIG. 2, $^{11}B^{30}$ was introduced into the RFQ accelerator 6 at an incident energy of 66 keV. On this condition the designed energy peak V for radio-frequency power was about 43 kV having a resonant frequency of 70.430 MHz.

Figures 11A, 11B, 11C:
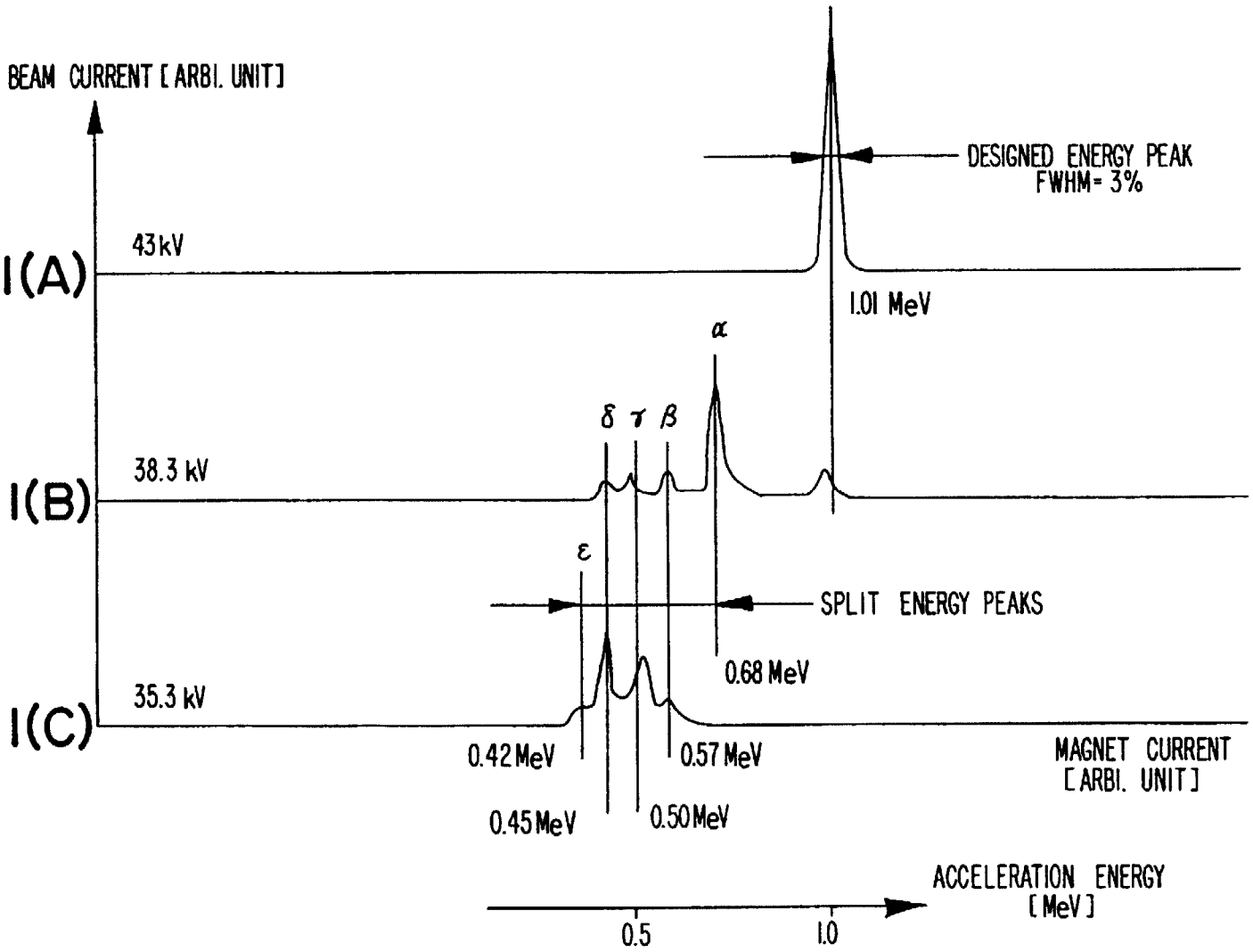
FIG. 11 is a graph showing the results of an experiment conducted by using the embodiment shown in FIG. 2.
Figure 12:
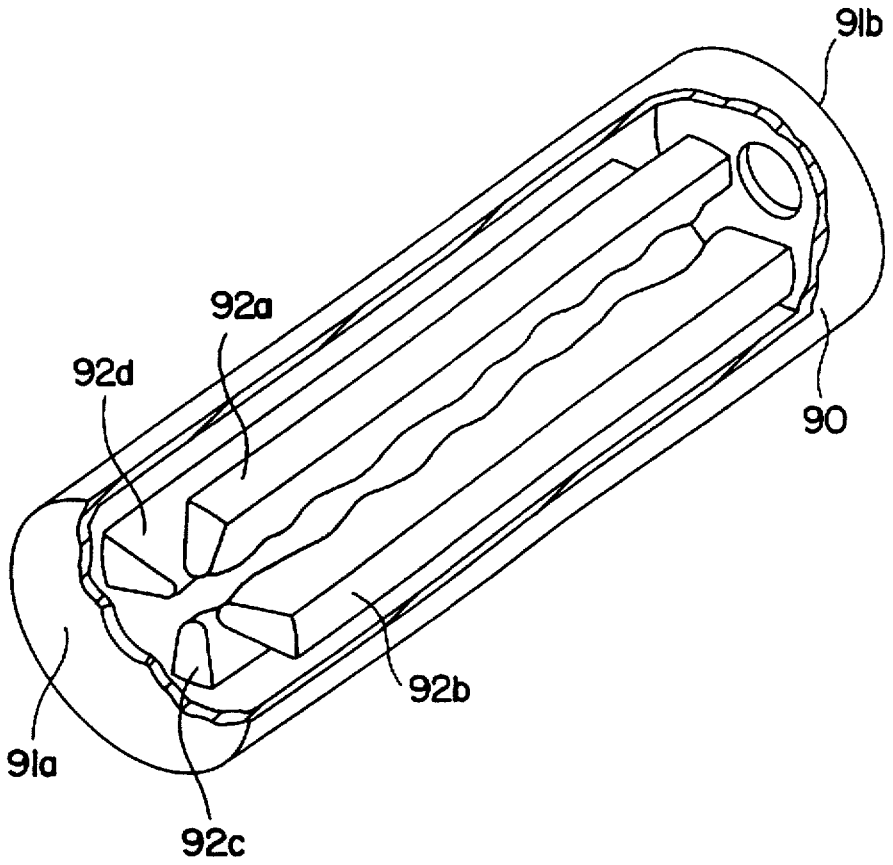
FIG. 12 is a perspective view showing a basic structure of a known RFQ accelerator.

FIG. 11 shows the results of the experiment depicted in graphs where the x-axis indicates the final energy and the y-axis indicates the beam current in each graph. The graph (A) shows a case where the designed energy peak 100% was applied to the vanes 92*a*–92*d*, and the graphs (B) and (C) show that 89% and 82% voltages were applied to each of the vanes 92*a*–92*d*.

As is evident from FIG. 11, when the radio-frequency voltage is shifted down lower than the designed energy peak V(=43 kV), the final particle energies individually reach peaks indicated by lines α, β, γ. . . in the areas where the energies are lower than the designed energy peak 1.01 MeV. These peaks appear with a steady energy irrespective of the amount of shift-down of radio-freqency voltage.

The final particle energy is represented by the equation (6). The energy value of a can be obtaindd by putting L=1 into the equation (6). Likewise, L =2, 3, 4 and 5 are put into the equation (6). Thus, the values of ≈, γ, δ, and ϵ are obtained.

The experiments have demonstrated that when the radio-frequency voltage is set approximately to voltage V'(=37.2 kV) expressed by the equation (5), it is most apparent that distinct energy peaks appear.

It should be apparent to those skilled in the art that the above-described invention can be implemented with other constructions. One such construction would be to utilize a computer as the voltage setting device 10 in the FIGS. 1 and 2. With the computer 10, WN' which is obtained as an approximate value by the equation (d) is obtained beforehand. For example, in the FIG. 11, with the use of equation (d), the following are obtained: WN'(L=1)=0.686 MeV, WN'(L=2)=0.588 MeV, WN'(L=3)=0.524 MeV, WN'(L=4) =0.476 MeV, and WN'(L=5)=0.438 MeV.

Then an approximate coincidence between each of the above values of WN' and the energy shift value that is obtained in the experiment for lowering the Vane voltage which is illustrated in FIG. 11 is obtained. Also, the most appropriate Vane voltage (see equation (5)) that allows WN' to be the largest peak is determined by way of experiment data, etc. All of these values are stored in the computer 10.

In particular and in accordance with the experimental data shown in FIG. 11, it can be confirmed that the values WN' {WN'(L=1)=0.686 MeV, WN'(L=2)=0.588 MeV, WN'(L=3) =0.524MeV, WN'(L=4)=0.476 MeV, and WN'(L=5)=0.438 MeV} and the energy shift value obtained by the experiments {α=0.68 MeV, β=0.57 MeV, Γ=0.50 MeV, δ=0.45 MeV,ϵ=0.42MeV} are almost coincident to each other. Furthermore, it is confirmed from the experiments as illustrated in FIG. 11 that the most appropriate Vane voltage is 38.3keV when WN'(L=1)=0.686MeV is at the largest peak, and the most appropriate Vane voltage is 35.3keV when WN'(L=4)=0.476MeV becomes the largest peak. While all of the data for all of the Vane voltages for obtaining the largest peaks for each of β, Γ, and ϵ are not set forth above, it should be apparent to one of ordinary skill in the art that these can be obtained in the same manner as a and S. All of these values are stored in the computer 10 and are used together with the controller 9 to control the operation of the radio frequency quadrapole accelerator.

According to the present invention, the conventional RFQ accelerator can be employed without substantial modification so as to make the acceleration energy variable, thereby decreasing production of ion emplantation and other products.

What is claimed is:

1. A method for controlling a particle acceleration energy in a radio-frequency quadrupole accelerator, using an RFQ accelerator including a cylindrical tank accommodating four electrodes extending axially of the tank, the electrodes defining a wavy acceleration cell around and along the axis of the cylindrical tank by the wavy edges of the electrodes, the tank being first supplied with a resonant frequency voltage having the same resonant frequency as that of the RFQ accelerator so as to put the tank into a resonant condition and then the wavy acceleration cell being supplied with charged particles at a predetermined incident energy, wherein the resonant frequency voltage is continuously shifted by a predetermined value below a voltage at which the resonant condition is effected.

2. A method according to claim 1, wherein the resonant frequency voltage is continuously shifted down to the value V' expressed by the equation:

$$V'=V\cos\phi_N$$

where $\phi_N$ ON is a radio-frequency phase angle of the wavy acceleration cells adjacent to the exit of the RFQ accelerator, and V is the voltage at which the resonant condition is effected.

3. A method for controlling a particle acceleration energy in a radio-frequency quadrapole accelerator according to claim 1, further comprising the steps of determining a resonant frequency voltage for each peak of the incident energy experimentally, storing the values for each peak incident energy and the corresponding resonant frequency voltage in a computer and controlling said radio-frequency quadrapole accelerator in accordance with data stored in said computer.

* * * * *

UNITED STATES PATENT AND TRADEMARK OFFICE

CERTIFICATE OF CORRECTION

PATENT NO. : 5,796,219

DATED : August 18, 1998

INVENTOR(S) : Akira Hirakimoto, et al.

It is certified that error appears in the above-indentified patent and that said Letters Patent is hereby corrected as shown below:

On the title page,

Item [76] Inventors: Change "Akira Hirakimoto, 2-1-6-401 Nishisakaidani-cho, Ohharno Nishigyo-ku Kyoto 604; Masatoshi Asari, 3-1-11 Shikanodai-Higashi, Ikoma Nara 630-01, both of Japan," to --Akira Hirakimoto, 3-1-11 Shikanodai-Higashi, Ikoma, Nara 630-01; Masatoshi Asari, 39-534 Kohata-Ogurayama, Uji, Kyoto 611, both of Japan--

Item [73] Assignee: Add --Shimadzu Corporation, Kyoto, Japan--

Signed and Sealed this

Eighteenth Day of May, 1999

*Attest:*

Q. TODD DICKINSON

*Attesting Officer*

*Acting Commissioner of Patents and Trademarks*